US010538986B2

(12) United States Patent
Stewart et al.

(10) Patent No.: US 10,538,986 B2
(45) Date of Patent: Jan. 21, 2020

(54) SUBSEA PRESSURE REDUCTION MANIFOLD

(71) Applicant: Ensco International Incorporated, Wilmington, DE (US)

(72) Inventors: Christopher Scott Stewart, Cornelius, NC (US); Benjamin Matthew Riley, Houston, TX (US); Steven Andrew Leppard, West University Place, TX (US); Justin Dow Alcorn, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/707,635

(22) Filed: Sep. 18, 2017

(65) Prior Publication Data

US 2018/0202253 A1 Jul. 19, 2018

Related U.S. Application Data

(60) Provisional application No. 62/446,792, filed on Jan. 16, 2017.

(51) Int. Cl.

| | |
|---|---|
| ***E21B 33/06*** | (2006.01) |
| ***E21B 33/064*** | (2006.01) |
| ***E21B 33/035*** | (2006.01) |
| ***E21B 33/038*** | (2006.01) |
| ***E21B 34/04*** | (2006.01) |

(52) U.S. Cl.

CPC ..... *E21B 33/064* (2013.01); *E21B 33/038* (2013.01); *E21B 33/0355* (2013.01); *E21B 34/04* (2013.01)

(58) Field of Classification Search

CPC ... E21B 33/064; E21B 33/0355; E21B 33/038

See application file for complete search history.

(56) References Cited

U.S. PATENT DOCUMENTS 3,656,549 A * 4/1972 Holbert, Jr. ..... E21B 33/035 166/356
3,865,142 A * 2/1975 Begun ..... E21B 33/0355 137/236.1
3,971,926 A * 7/1976 Gau ..... G06F 17/5009 175/50
5,046,896 A * 9/1991 Cole ..... B63B 22/021 166/344
6,032,736 A * 3/2000 Williams ..... E21B 33/064 166/250.08

(Continued)

OTHER PUBLICATIONS

PCT Application No. PCT/US2018/013773 International Search Report and the Written Opinion dated Jun. 19, 2018, 19 pages.

*Primary Examiner* — Matthew R Buck
*Assistant Examiner* — Aaron L Lembo
(74) *Attorney, Agent, or Firm* — Fletcher Yoder, P.C.

(57) ABSTRACT

Techniques and systems to provide pressure reduction of a fluid, for example, from a well. A device includes an input configured to be fluidly coupled to a well control device. The device also includes an output configured to be to be fluidly coupled to the well control device. The device further includes at least one valve configured to alter a pressure of a fluid received at the input and transmitted from the output.

20 Claims, 6 Drawing Sheets

(56) References Cited

U.S. PATENT DOCUMENTS 6,044,690 A * 4/2000 Williams ..... E21B 33/063 166/250.08
7,062,960 B2 * 6/2006 Couren ..... E21B 33/061 73/152.51
7,274,989 B2 * 9/2007 Hopper ..... E21B 41/00 166/255.1
7,610,251 B2 * 10/2009 Shayegi ..... G05B 13/048 706/21
7,726,405 B2 * 6/2010 McMiles ..... F16L 55/05 166/339
8,820,410 B2 * 9/2014 Parks ..... E21B 33/0355 166/339
8,886,504 B2 * 11/2014 Standifird ..... E21B 44/00 166/85.4
9,033,049 B2 5/2015 Kotrla et al.
9,175,539 B2 * 11/2015 Livesay ..... E21B 33/0355
9,702,215 B1 * 7/2017 Murphy ..... E21B 33/076
9,863,206 B2 * 1/2018 Biester ..... E21B 33/064
2011/0297388 A1 * 12/2011 Stave ..... E21B 21/08 166/345
2011/0311311 A1 * 12/2011 Brey ..... E21B 33/035 405/60
2012/0186820 A1 7/2012 Donahue et al.
2012/0294114 A1 * 11/2012 Gochnour ..... E21B 43/0122 367/13
2012/0318529 A1 12/2012 Herrold et al.
2013/0092385 A1 * 4/2013 Curtiss, III ..... E21B 34/16 166/336
2013/0140035 A1 * 6/2013 Smith ..... E21B 43/0122 166/345
2013/0311093 A1 * 11/2013 Winters ..... E21B 47/06 702/6
2014/0034337 A1 * 2/2014 Van Wijk ..... E21B 33/06 166/387
2014/0374118 A1 12/2014 Landrith, II et al.
2015/0034384 A1 2/2015 Leuchtenberg
2015/0129233 A1 5/2015 Gaude et al.
2015/0211331 A1 * 7/2015 McHugh ..... E21B 33/037 166/336
2016/0090810 A1 * 3/2016 Holmes ..... E21B 34/16 166/363
2016/0109874 A1 * 4/2016 Holmes ..... G05B 19/406 700/275
2017/0081945 A1 * 3/2017 Nedwed ..... E21B 41/0007
2017/0089163 A1 * 3/2017 Vitou ..... E21B 33/063
2017/0145773 A1 * 5/2017 van Wijk ..... E21B 33/064
2017/0167220 A1 * 6/2017 Jaffrey ..... E21B 33/062
2018/0080301 A1 * 3/2018 Drobniak ..... E21B 33/064
2018/0087340 A9 * 3/2018 Jaffrey ..... E21B 33/062

* cited by examiner

SUBSEA PRESSURE REDUCTION MANIFOLD

CROSS REFERENCE TO RELATED APPLICATIONS

This application is a Non-Provisional Application claiming priority to U.S. Provisional Patent Application No. 62/446,792, entitled "Subsea Pressure Reduction Manifold", filed Jan. 16, 2017, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP).

Subsea BOPs perform many functions that allow the wellbore to be secured during normal and emergency drilling operations. Due to demanding drilling programs, regulatory requirements, and/or further reasons, additional functionality is being demanded of these BOPs. These increased demands may lead to increased capability requirements for the BOP.

DETAILED DESCRIPTION

Figure 1:
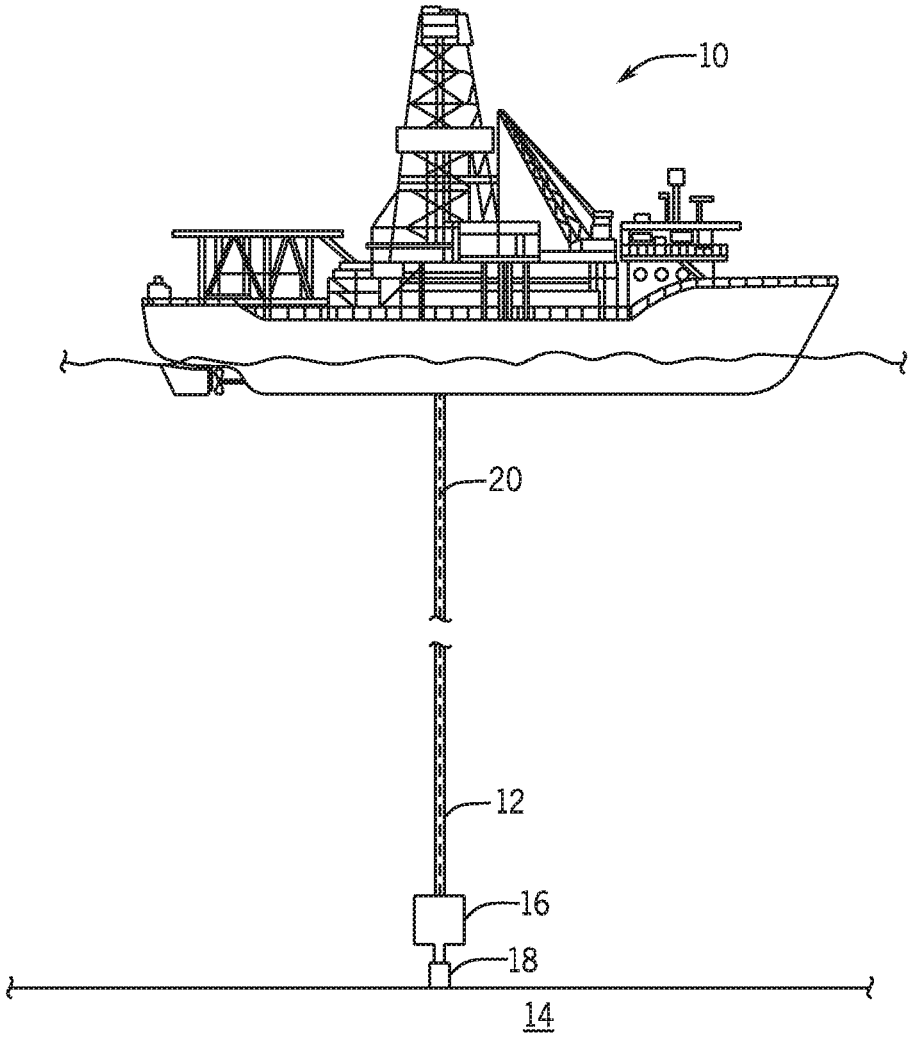
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Demands for increased capabilities of well control devices, such as blowout preventers (BOPs), are continuing and the operation of BOPs include multiple functions that allow for a wellbore to be secured during normal operations, as well as in emergency situations. Some of these demands take the form of increases in hydraulic pressures utilized by, for example, rams of one or more BOPs in a BOP stack and may utilize pressures up to and exceeding 20,000 pounds per square inch (psi). For example, when an influx of formation fluids enters a wellbore during conventional drilling or completion operations (e.g., a kick), the BOPs must be closed to secure the wellbore and prevent the influx from reaching the surface. It is desirable to then circulate the influx out of the well in a controlled manner.

To allow for the increased pressure requirements of utilizing a high pressure BOP stack (e.g., 20,000 psi or greater), a surface vessel having a surface choke manifold rated to 20,000 psi or greater as well as an associated system to operate the high pressure BOP stack may involve alterations to a riser string, alterations to a BOP handling system due to increased weight of the high pressure BOP stack, and the like, which may result in equipment acquisition costs and/or vessel modifications to accommodate the equipment. Accordingly, in one embodiment, a subsea pressure reducing manifold may be utilized to reduce pressures associated with a high pressure BOP stack (e.g., 20,000 psi or greater) to approximately 15,000 psi or less, such that the high pressure BOP stack (e.g., at 20,000 psi or greater) can be utilized with existing offshore equipment rated to operate at 15,000 psi or less.

For example, a secondary, higher pressure rated (e.g., 20,000 psi or greater), subsea pressure reducing manifold (e.g., a choke manifold) may be utilized to reduce the pressure from wellbore influx such that the influx may pass through existing lower pressure rated (e.g., 15,000 psi rated) equipment. The subsea (secondary) pressure reducing manifold may be located on a secondary BOP stack rated for a higher pressure (e.g., 20,000 psi) than a primary lower pressure BOP stack (e.g., 15,000 psi). In another embodiment, the subsea pressure reducing manifold may be located on the seabed with, for example, high pressure piping, hoses, flying leads, or similar connecting the subsea pressure reducing manifold to the secondary BOP stack.

A primary (lower pressure) BOP control system may be utilized to operate the secondary (higher pressure) BOP stack. Communication to the secondary BOP stack may be through a multiplex cable (i.e., mux cable) that is coupled through the primary stack via a wet-mate or inductive connections to the secondary BOP stack. The existing surface control panels may be used to operate the secondary BOP stack with, for example, the addition of extra screens in the event that a touch screen is used, or an additional push button panel.

Additionally, the hydraulic supply pressure of the primary BOP stack, provided from the surface, may be used to operate the control system of the secondary BOP stack. A conduit pressure may be passed through manifolds typically used by the control system of the primary BOP stack to provide hydraulic supply to pods on the lower marine riser package (LMRP). In some embodiments, fluid may be controllable from the primary BOP stack control system to be supplied or isolated from the control system of the secondary BOP stack. This fluid may pass through a series of pressure balances or weight set connections that route the fluid from the LMRP, past the primary BOP stack, and to the controls of the secondary BOP stack.

Furthermore, high pressure drill pipe may be deployed and connected to, for example, a receptacle assembly via a stab mounted on the drill pipe, or via a hose with a breakaway connection, or similar device, that is connected to the subsea pressure reducing manifold to allow high pressure fluid to be pumped into the wellbore (i.e., bullheading the well). This high pressure drill pipe may be supported by, for example, top drive elevators. The high pressure drill pipe may be compensated by an inline compensator, a crown-mounted compensator, and active heave drawworks, or similar device.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a jack up drilling platform, a spar platform, a floating production system, or the like may be substituted for the illustrated drillship. Indeed, while the techniques and systems described below are described in conjunction with a drillship, the techniques and systems are intended to cover at least the additional offshore platforms 10 described above.

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 (e.g., a well control device) that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18.

Figure 2:
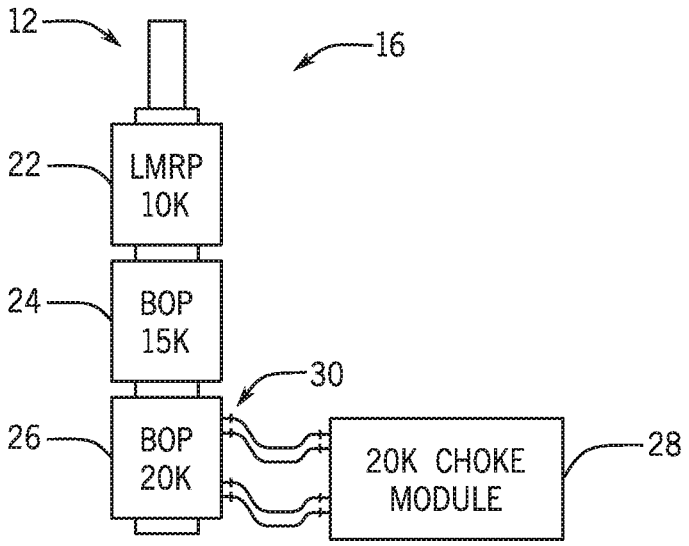
FIG. 2 illustrates a schematic view of the BOP of FIG. 1, in accordance with an embodiment.

FIG. 2 illustrates a schematic view of the BOP 16 of FIG. 1. As illustrated, the BOP 16 may include a lower marine riser package (LMRP) 22, which may be coupled the riser 12 as well as an upper BOP stack 24, which itself may be coupled to a lower BOP stack 26. In some embodiments, the lower BOP stack 26 may operate either independently or in combination with the LMRP 22 and/or the upper BOP stack 24. Additionally, as illustrated, LMRP 22 may be rated for approximately 10,000 psi, the upper BOP stack 24 may be termed a low pressure BOP stack and may be rated for approximately 15,000 psi, and the lower BOP stack 26 may be a termed a high pressure BOP stack and may be rated for approximately 20,000 psi or more. In some embodiments, the LMRP 22 may include a riser connector that allows for fluid connection between the riser 12 and the upper BOP stack 24 one or more annular BOPs that may consist of a large valve used to control wellbore fluids through mechanical squeezing of a sealing element about the drill pipe 12, and one or more ball or flex joints that allow for angular movement of the riser 12 with respect to the LMRP 22, for example, allowing for movement of the riser 12 due to movement of the drillship 10.

The upper BOP stack 24 may include one or more ram preventers, which may include a set of opposing rams that are designed to close within a bore (e.g., a center aperture region about drill pipe 20) of the BOP 16, for example, through hydraulic operation. Each of the ram preventers may include cavities through which the respective opposing rams may pass into the bore of the BOP 16. These cavities may include, for example, shear ram cavities that house shear rams (e.g., hardened tool steel blades designed to cut/shear the drill pipe 20 then fully close to provide isolation or sealing of the offshore platform 10 from the wellbore 18). The ram preventers may also include, for example, pipe ram cavities that house pipe rams (e.g., horizontally opposed sealing elements with a half-circle holes therein that mate to form a sealed aperture of a certain size through which drill pipe 20 passes) or variable bore rams (e.g., horizontally opposed sealing elements with a half-circle holes therein that mate to form a variably sized sealed aperture through which a wider range of drill pipes 20 may pass). The ram preventers may be single-ram preventers (having one pair of opposing rams), double-ram preventers (having two pairs of opposing rams), triple-ram preventers (having three pairs of opposing rams), quad-ram ram preventers (having four pairs of opposing rams), or may include additional configurations.

The upper BOP stack 24 may further include failsafe valves. These failsafe valves may include, for example, choke valves and kill valves that may be used to control the flow of well fluids being produced by regulating high pressure fluids passing through respective conduits (e.g., a choke line and a kill line) arranged laterally along the riser 12 to allow for control of the well pressure. The ram preventers may include vertically disposed side outlets that allow for the failsafe valves to be coupled to the upper BOP stack 24. Typically, the failsafe valves are arranged in a staggered configuration along the side outlets of the ram preventers such that the failsafe valves are disposed on opposing sides of the ram preventers and in separate vertical planes from one another. However, alternate configurations may be employed.

As previously noted, the lower BOP stack 26 may be rated to a higher pressure of approximately 20,000 psi or more (e.g., the lower BOP stack 26 may be able to hold at pressures of up to 20,000 psi or more) relative to the upper BOP stack 24, which may be rated to a lower pressure of approximately 15,000 psi (e.g., the upper BOP stack 24 may be able to hold at pressures of up to 15,000 psi). However, in some embodiments, the riser 12 (as well as associated equipment) may only be rated to 15,000 psi. Accordingly, a subsea pressure reducing module (e.g., choke module) 28 may additionally be employed so that an existing riser 12 and associated equipment rated at, for example, pressures of up to 15,000 psi may be used in conjunction with the lower BOP stack 26.

Figure 3:
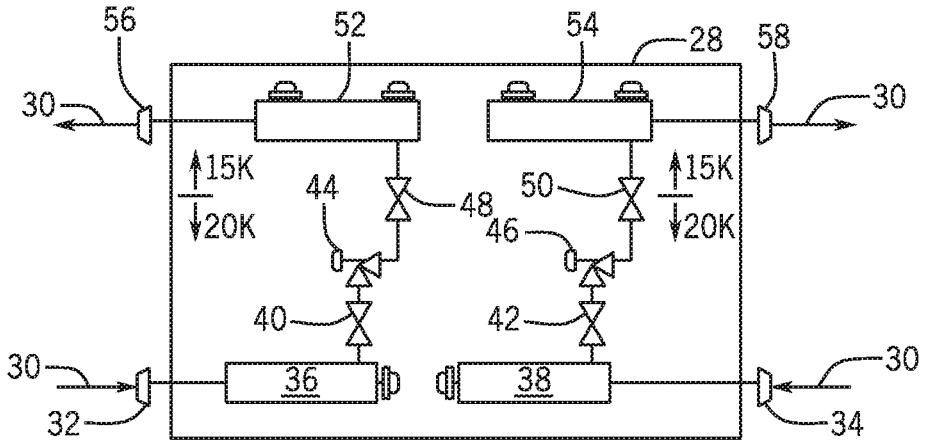
FIG. 3 illustrates a schematic view of the subsea pressure reducing module of FIG. 2, in accordance with an embodiment.

In some embodiments, the subsea pressure reducing module 28 may be disposed on the seafloor 14 and may be coupled to the lower BOP stack 26 via one or more passages 30, for example, high pressure piping, hoses, flying leads, or similar passages. In other embodiments, the subsea pressure reducing module 28 may be located in or on (e.g., as part of, integral to, or affixed to) the BOP 16, e.g., the lower BOP stack 26. FIG. 3 illustrates one example of a subsea pressure reducing module 28 that may be utilized.

The subsea pressure reducing module 28 may be utilized to lower a pressure of a fluid received from the wellhead 18. For example, a wellbore influx (e.g., a kick) inclusive of the undesirable flow of formation fluids (e.g., one or more of gas, oil, salt water, magnesium chloride water, hydrogen sulfide (sour) gas, carbon dioxide, etc.) into the wellbore may be detected. In response, one or more of the lower BOP stack 26 and/or the upper BOP stack 24 may be utilized to seal (e.g., close off) the well so as to prevent the influx from being transmitted to the surface in an uncontrolled manner.

Typically, the influx would be transmitted along a choke line (e.g., a line or pipe leading from an outlet on one or both of the lower BOP stack 26 and/or the upper BOP stack 24) during a well control operation, such that the influx would flow out of the well through the choke line to a surface choke manifold, which would operate to reduce the pressure of the transmitted fluid to, for example, atmospheric pressure. However, as previously noted, fluid pressures sealed by the lower BOP stack 26 may exceed the pressure rating of the equipment associated with the upper BOP stack 24 (e.g., the riser, the choke line, a kill line, typically used to facilitate the pumping of fluid into the wellbore or used in conjunction with the choke line to remove the influx fluid in parallel with the choke line or in place of the choke line if the choke line is, for example, damaged, whereby the choke line and the kill line are disposed along the riser 12, as well as additional associated equipment associated with the upper BOP stack 24). Accordingly, the subsea pressure reducing module 28 may include inputs 32 and 34 (e.g., a connector or the like) that may each be coupled to a respective passage 30. In one embodiment, the input 32 may be coupled via a passage 30 to an output of the lower BOP stack 26 that may, typically, supply or be connected to a choke line of the lower BOP stack 26. Likewise, the input 34 may be coupled via a passage 30 to an output of the lower BOP stack 26 that may, typically, supply or be connected to a kill line of the lower BOP stack 26. In some embodiments, the inputs 32 and 34 are able to receive fluids at pressures up to or exceeding approximately 20,000 psi.

Each of input 32 and 34 of the subsea pressure reducing module 28 may be coupled to a respective choke inlet 36 or kill inlet 38 that may operate, for example, as manifolds to contain fluids in the subsea pressure reducing module 28. The subsea pressure reducing module 28 may also include isolation valves 40 and 42 that may be, for example, 3 inch diameter isolation valves or another size and may be utilized to allow or prevent the flow of fluid from the respective choke inlet 36 or kill inlet 38 to which the respective isolation valve 40 and 42 is coupled. Additionally, the subsea pressure reducing module 28 may include choke valves 44 and 46. The choke valves 44 and 46 may be coupled to a respective isolation valve 40 and 42 and may operate to, for example, reduce the pressure of the fluid received from the lower BOP stack 26 (e.g., from the respective choke line or kill line outlets of the lower BOP stack 26) from up to or exceeding approximately 20,000 psi to approximately 15,000 psi. In some embodiments the choke valves 44 and 46 may be adjustable choke valves that operate to adjust an amount of flow through the valve 44 and 46 by reducing the flow area through the valve body to achieve a desired flow rate. In some embodiments, the diameter of the choke valves 44 and 46 may be equivalent to the diameter of the respective isolation valves 40 and 42 coupled thereto.

The subsea pressure reducing module 28 may further include isolation valves 48 and 50 that may be, for example, 3 inch diameter isolation valves or another size and may be utilized to allow or prevent the flow of fluid from the respective choke valves 44 and 46 to which the respective isolation valve 48 and 50 is coupled. In some embodiments, the diameter of the isolation valves 48 and 50 may be equivalent to the diameter of the respective isolation valves 40 and 42 and/or the respective choke valves 44 and 46 coupled thereto. The isolation valves 48 and 50 may be coupled to respective choke outlets 52 and 54, which may operate as manifolds to contain fluids in the subsea pressure reducing module 28. Likewise, the choke outlets 52 and 54 may be coupled to respective outlets 56 and 58, which may be coupled to the lower BOP stack 26 via respective passages 30. The outlets 56 and 58 may operate to transmit reduced pressure fluids (e.g., at approximately 15,000 psi or less) to the lower BOP stack 26 for subsequent transmission to the upper BOP stack 24 via, for example, a respective choke and kill line of the lower BOP stack 26.

Figure 4:
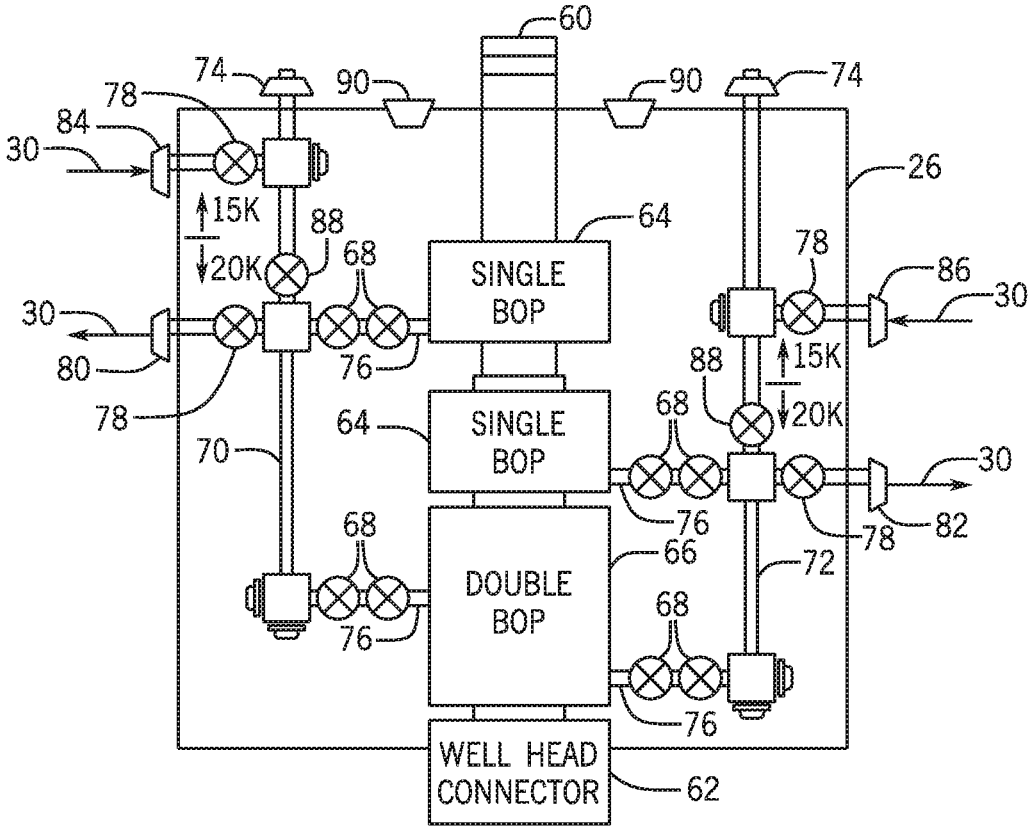
FIG. 4 illustrates a schematic view of the lower BOP stack of FIG. 2, in accordance with an embodiment.

As illustrated in FIG. 4, the lower BOP stack 26 may include an upper mandrel 60 that can operate to couple the lower BOP stack 26 to the upper BOP stack 24 and a wellhead connector 62 that may allow the lower BOP stack 26 to be coupled to wellhead 18. Furthermore, the lower BOP stack 24 may include one or more ram preventers 64 and 66. Each ram preventer 64 and 66 may include a set of opposing rams that are designed to close within a bore (e.g., a center aperture region about drill pipe 20) of the BOP 16, for example, through hydraulic operation. The ram preventers 64 may be single-ram preventers (having one pair of opposing rams) while the ram preventers 66 may be double-ram preventers (having two pairs of opposing rams). However, additional or alternative ram preventers such as triple-ram preventers (having three pairs of opposing rams), quad-ram ram preventers (having four pairs of opposing rams), or the like may be used such that the lower BOP stack 26 may include additional configurations.

One or more of the ram preventers 64 and 66 may include shear rams (e.g., hardened tool steel blades designed to cut/shear the drill pipe 20 then fully close to provide isolation or sealing of the wellbore) pipe rams (e.g., horizontally opposed sealing elements with a half-circle holes therein that mate to form a sealed aperture of a certain size through which drill pipe 20 passes), variable bore rams (e.g., horizontally opposed sealing elements with a half-circle holes therein that mate to form a variably sized sealed aperture through which a wider range of drill pipes 20 may pass), or the like. The lower BOP stack 26 may further include failsafe valves 68. These failsafe valves 68 may include, for example, choke valves and kill valves that may be used to control the flow of well fluids being produced by regulating high pressure fluids passing through the respective choke line 70 and kill line 72, which exit the lower BOP stack 26 via connectors 74 to the upper BOP stack 24 and, thereafter, are arranged laterally along the riser 12 to the offshore platform 10 to allow for control of the well pressure. The ram preventers 64 and 66 may also include vertically disposed side outlets 76 that allow for the failsafe valves 68 to be coupled to the respective choke line 70 and kill line 72.

Additionally, as illustrated, the lower BOP stack 26 may include one or more isolation valves 78 that may be utilized to allow or prevent flow of, for example, an influx to respective outputs 80 and/or 82 or from inputs 84 and/or 86. As illustrated, the output 80 may be a choke output connector that is connected to passage 30 as well as to input 32 (e.g., the input choke connector of the subsea pressure reducing module 28). Similarly, the output 82 may be a kill output connector that is connected to passage 30 as well as to input 34 (e.g., the input kill connector of the subsea pressure reducing module 28). Likewise, input 84 may be a choke input connector that is connected to passage 30 as well as to output 56 (e.g., the output choke connector of the subsea pressure reducing module 28) while the input 86 may be a kill input connector that is connected to passage 30 as well as to output 58 (e.g., the output kill connector of the subsea pressure reducing module 28). Additionally, the lower BOP stack 26 may include isolation valves that 88 that may typically remain closed, but may also be opened to, for example, allow for fluids to be transmitted through the choke line 72 and the kill line 74. Likewise, lower BOP stack 26 may include one or more interfaces 90 that may represent, for example, control fluid and/or multiplexer interfaces that are used to control operation of the lower BOP stack 26 and/or the aforementioned components thereof. In some embodiments, a dedicated control for the lower BOP stack 26 may be present. Alternatively, in some embodiments, a control system of the upper BOP stack 24 may be utilized to operate the secondary BOP stack 26, as described below in conjunction with respect to FIG. 6.

Figure 5:
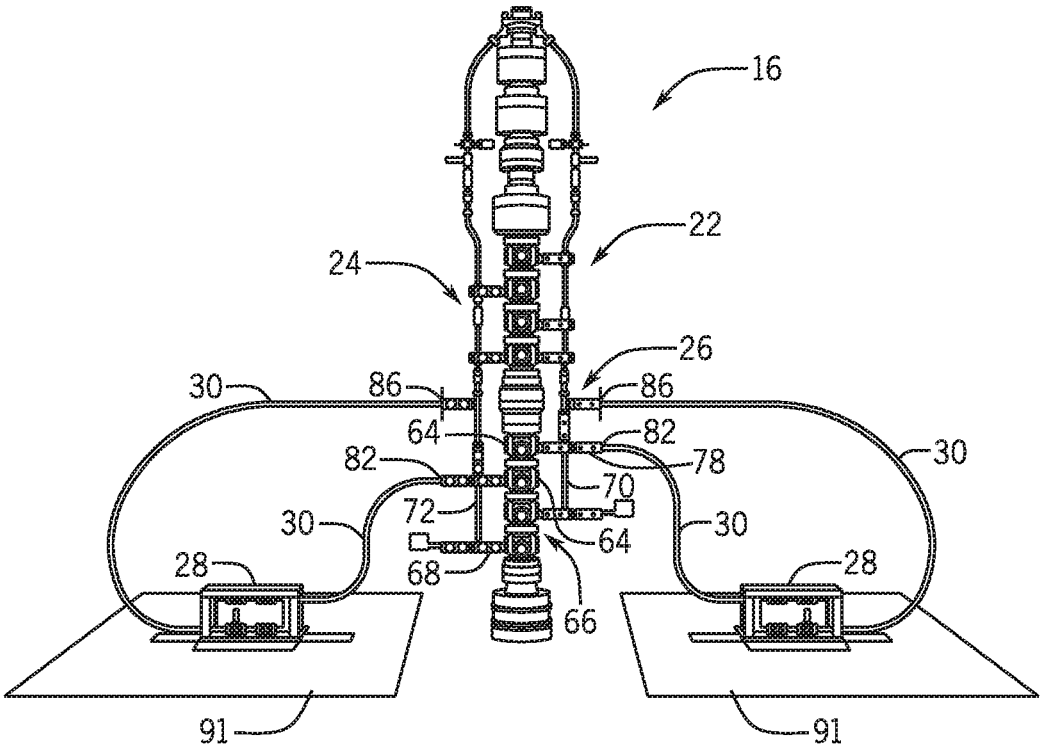
FIG. 5 illustrates a side view of the BOP of FIG. 1 and the subsea pressure reducing module of FIG. 2, in accordance with an embodiment.

FIG. 5 illustrates a drilling platform BOP 16 as coupled to two separate pressure reducing modules 28. While two separate pressure reducing modules 28 are illustrated, in some embodiments, a single pressure reducing module 28 may be utilized whereby the single pressure reducing module 28 receives fluids from both output 80 and output 82 and transmits fluids to inputs 84 and 86. As illustrated, each of the pressure reducing modules are disposed adjacent to the BOP 16, for example, on a mudmat 91, which may operate as a seafloor support to provide load distribution for the subsea equipment disposed thereon.

Figure 6:
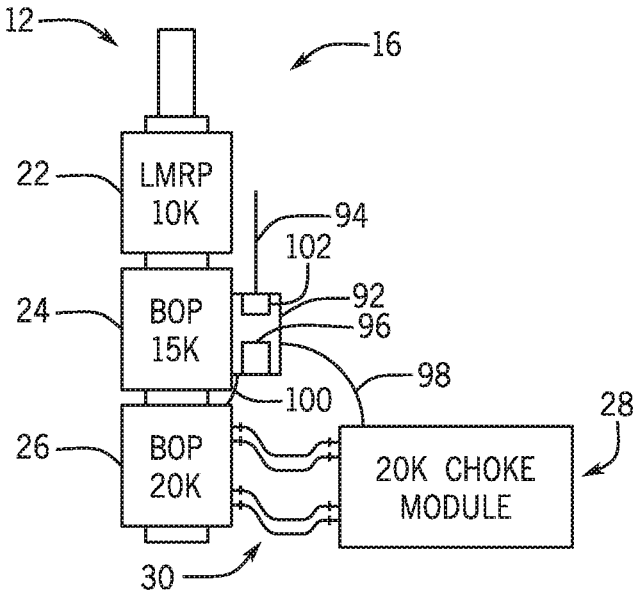
FIG. 6 illustrates a second schematic view of the BOP of FIG. 1, in accordance with an embodiment.

FIG. 6 illustrates a second schematic view of the BOP 16 of FIG. 1. As illustrated, the BOP 16 may include at least one subsea control system 92 (e.g., a BOP control pod) that operates as an interface between control lines 94 that supply hydraulic and/or electric power and signals from the offshore platform 10, for example, to the BOP 16 and/or other subsea equipment to be monitored and controlled (e.g., the subsea pressure reducing module 28). In some embodiments, the subsea control system 92 may be coupled to a surface control system of the offshore platform 10 for use with the BOP 16. The subsea control system 92 may include a subsea control monitor 96. The subsea control system 92 (e.g., the subsea control monitor 96) may be coupled to line 98 to receive, from the subsea pressure reducing module 28, one or more signals indicative of whether the subsea pressure reducing module 28 is operating to reduce the pressure of a received fluid to approximately 15,000 psi or less. To aid in this determination, one or more of the subsea pressure reducing module 28 or the subsea control system 92 may be instrumented to read pressure after the choke valves 44 and 46 to ensure that the choke line and kill line of the upper BOP stack 24 (respectively coupled to choke line 70 and kill line 72) are not over pressured. Likewise the lower BOP stack 26 may be instrumented to provide pressure indications, via line 100, to the subsea control system 92 of the wellbore. This instrumentation may be communicated through local control equipment on the lower BOP stack 26 which may work in tandem with the subsea control system 92.

Additionally and/or alternatively, one or more connections may be coupled from the subsea control system 92 to the lower BOP stack 26 via the one or more interfaces 90 for control of the lower BOP stack 26 and/or the components therein. For example, communication may be through a multiplex cable (i.e., mux cable) that is coupled through the upper BOP stack 24 via a wet-mate or inductive connections to the lower BOP stack 26. Likewise, the subsea control system 92 may be coupled via one or more connections to the subsea pressure reducing module 28 for control of the subsea pressure reducing module 28 and/or the components therein.

In some embodiments, the subsea control system 92 may pre-analyze/compute the raw inputted data and provide an output having less data than input to the subsea control module 96, to reduce the amount of data provided to the surface. To accomplish this, the subsea control monitor 96 may include one or more processors, a controller, an application specific integrated circuit (ASIC), and/or another processing device that interacts with one or more tangible, non-transitory, machine-readable media of the subsea control monitor 96 that collectively stores instructions executable by the controller to perform the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the subsea control monitor 96 or by any processor, controller, ASIC, or other processing device therein.

The subsea control system 92 may route the signals it generates to a communication system 102. The communication system may be, for example, an acoustic communication system that includes an acoustic beacon that may transmit an indication of any signals received by, for example, the subsea control monitor 96. In other embodiments, the communication system 102 may additionally or alternatively include other wireless transceivers or transmitters separate from the acoustic communication system that may be utilized in place of or in addition to the acoustic communication system to transmit indications from the subsea control system 92 to the offshore platform 10. Likewise, the communication system 102 may additionally or alternatively include an electrical or electro-hydraulic communication system that may communicate via a control umbilical or through a dedicated umbilical deployed along the riser 12. Moreover, the subsea control monitor 96 may receive signals indicative of whether the subsea pressure reducing module 28 is operating properly (e.g., reducing fluid pressure to approximately 15,000 psi), and the subsea control monitor 96 or the subsea control system 92 may operate to control operation of the BOP 16 and/or the subsea pressure reducing module 28 (e.g., control operation of the respective valves 40, 42, 44, 46, 48, 50, 68, 78, and/or 88, and/or the ram preventers 64 and 66) based on received signals from the BOP 16, the subsea pressure reducing module 28, and/or signals received from a surface control system.

The surface control system may include an interface junction. The interface junction may receive signals from, for example, an acoustic junction box and/or from a dedicated umbilical deployed along the riser 12. The acoustic junction box may receive signals from an acoustic beacon. The received signals from the acoustic junction box and/or from a dedicated umbilical may include transmitted indications of any signals received by the subsea control monitor 92. In other embodiments, other wireless transceivers or receivers may be utilized in place of or in addition to the acoustic junction box and/or the dedicated umbilical.

The surface BOP control system may include or may be coupled to a computing system. This computing system may be a control system, for example, in a driller's cabin that may provide a centralized control system for drilling controls and the like (e.g., a main control system of the offshore platform 10). The computing system of the offshore platform 10 may operate in conjunction with software systems implemented as computer executable instructions stored in a non-transitory machine readable medium of computing system, such as memory, a hard disk drive, or other short term and/or long term storage. Particularly, the techniques to monitor and/or control the subsea pressure reducing module 28 may be performed using include code or instructions stored in a non-transitory machine-readable medium (e.g., memory and/or storage) and may be executed, for example, by one or more processors or a controller of computing system. Accordingly, computing system may include an application specific integrated circuit (ASIC), one or more processors, or another processing device that interacts with one or more tangible, non-transitory, machine-readable media of computing system that collectively stores instructions executable by the controller the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor or by any general purpose or special purpose computer or other machine with a processor.

Thus, the computing system may include a processor that may be operably coupled with the memory to perform various algorithms. Such programs or instructions executed by the processor(s) may be stored in any suitable article of manufacture that includes one or more tangible, computer-readable media at least collectively storing the instructions or routines, such as the memory. Additionally, the computing system may include a display may be a liquid crystal display (LCD) or other type of display that allows users to view images generated by the computing system. The display may include a touch screen, which may allow users to interact with a user interface of the computing system.

The computing system may also include one or more input structures (e.g., a keypad, mouse, touchpad, one or more switches, buttons, or the like) to allow a user to interact with the computing system, such as to start, control, or operate a GUI or applications running on the computing system. Additionally, the computing system may include network interface to allow the computing system to interface with various other electronic devices. The network interface may include a Bluetooth interface, a local area network (LAN) or wireless local area network (WLAN) interface, an Ethernet connection, or the like. The computing system may receive indications of the operation and/or status of the BOP 16 and/or the subsea pressure reducing module 28. The surface control panels may be used to operate the lower BOP stack 26 and/or the subsea pressure reducing module 28 with, for example, the addition of extra screens in the event that a touch screen is used, or an additional push button panel.

Additionally, hydraulic supply pressure for the upper BOP stack 24, provided from the surface, may be used to operate the control system of the lower BOP stack 26 (e.g., either an independent control system or the subsea control system 92). In some embodiments, the conduit pressure may be passed through manifolds typically used by the upper BOP stack 24 control system (e.g., subsea control system 92) to provide hydraulic supply to the pods on the LMRP 22. This fluid may be controllable from the upper BOP stack 24 control system (e.g., subsea control system 92) to be supplied or isolated from any separate control system of the lower BOP stack 26. Additionally, this fluid may pass through a series of pressure balances or weight set connections that route the fluid from the LMRP 22, past the upper BOP stack 24, and to controls on the lower BOP stack 26.

In other embodiments, high pressure drill pipes (taken together to be a drill string) may be able to transmit fluids having pressures up to or greater than 20,000 psi (e.g., to allow high pressure fluid to be pumped into the wellbore, bullheading the well) may be deployed and connected to, for example, a receptacle assembly via a stab mounted on the drill string, or via a hose with a breakaway connection, or similar device, that is connected to the subsea pressure reducing module 28. The drill pipes may be supported by, for example, one or more top drive elevators on the offshore platform 10. The drill pipes may also be compensated by an inline compensator, a crown-mounted compensator, and active heave drawworks, or similar device on the offshore platform 10.

Figure 7:
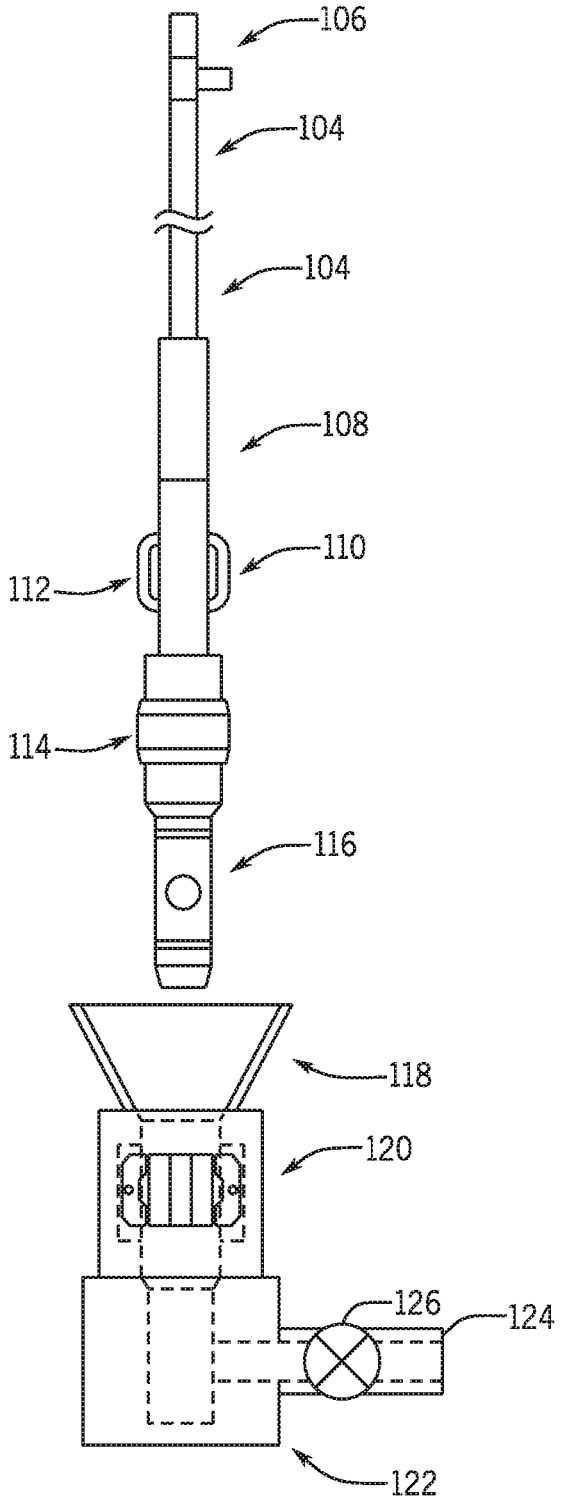
FIG. 7 illustrates a first schematic view of a drill string and associated equipment for use with the offshore platform of FIG. 1, in accordance with an embodiment.

FIG. 7 illustrates a first example of the aforementioned high pressure drill pipes 104 used in place of the previously discussed drill pipes 20 as a portion of a drill string. As illustrated, the drill pipes 104 may be coupled to a side entry sub 106, which may be a component of the drill string, such as a short drill collar or a thread crossover and may allow for pipe recovery, wireline tool fishing, directional drilling, or other operations. The side entry sub 106 may be coupled to, for example, a swivel joint inclusive of metal pipe fittings with integral ball-bearing swivels and/or a hose or other connection from a cement standpipe system capable of supplying cement (e.g., to seal formations to prevent loss of drilling fluid).

In some embodiments, the drill pipes 104 may be vertically supported by elevators from one or more top drives, which may operate to impart rotation to the drill string either as a primary or a backup rotation system. Additionally, the drill pipes 104, indeed the drill string formed therefrom, may also have its motion compensated for by crown mounted compensators, which apply a constant tension to the drill string and compensate for any rig movement, and/or drawworks, which may be a large spool that is powered to retract and extend drilling line (e.g., wire cable) over a crown block (e.g., a vertically stationary set of one or more pulleys or sheaves through which the drilling line is threaded) and a travelling block (e.g., a vertically movable set of one or more pulleys or sheaves through which the drilling line is threaded) to operate as a block and tackle system for movement of the top drive, an elevator, and any tubular member (e.g., drill pipes 104) coupled thereto.

The drill pipes 104 may also be coupled to, for example, one or more drill collars 108 (e.g., tubular pieces that provide weight on a bit for drilling). In some embodiments, the one or more drill collars 108 may have a diameter of approximately 9.5 inches or more. The one or more drill collars 108 may be coupled to one more remotely operated vehicle (ROV) subs 110 that may include one or more handles 112 to allow the ROV to more easily access and position the one or more subs 110 and, accordingly, the drill string. Additionally, the one or more subs 110 may have a snap in/snap out profile 114 to assist in connection thereof. In one embodiment, the one or more subs 110 may also include a stab 116, such as a hot stab, that allows for threads of a piece of the drill string into the mating female threads (e.g., disposed in or below an entry funnel of a stab receptacle 118), prior to making up the connection while under pressure.

Also illustrated in FIG. 7 is a retainer 120, such as a cam type snap in/snap out retainer, which may, in one embodiment, allow for up to 20,000 foot pounds of force actuation. Likewise, the stab structure 122 may, in some embodiments, allow for up to approximately 40,000 foot pounds of set down force, up to approximately 40,000 foot pounds of set down force, approximately 60,000 foot pounds of retaining force (the set down force and the actuation force). Additionally, the stab structure 122 may include an output 124 that may be coupled to input 34 (e.g., the input kill connector of the subsea pressure reducing module 28), whereby control of the fluid transmitted to the input 34 may be actuated by valve 126. This connection will allow for de-pressurization of fluids via the subsea pressure reducing module 28 prior to any transmission thereof to the offshore platform 10.

Figure 8:
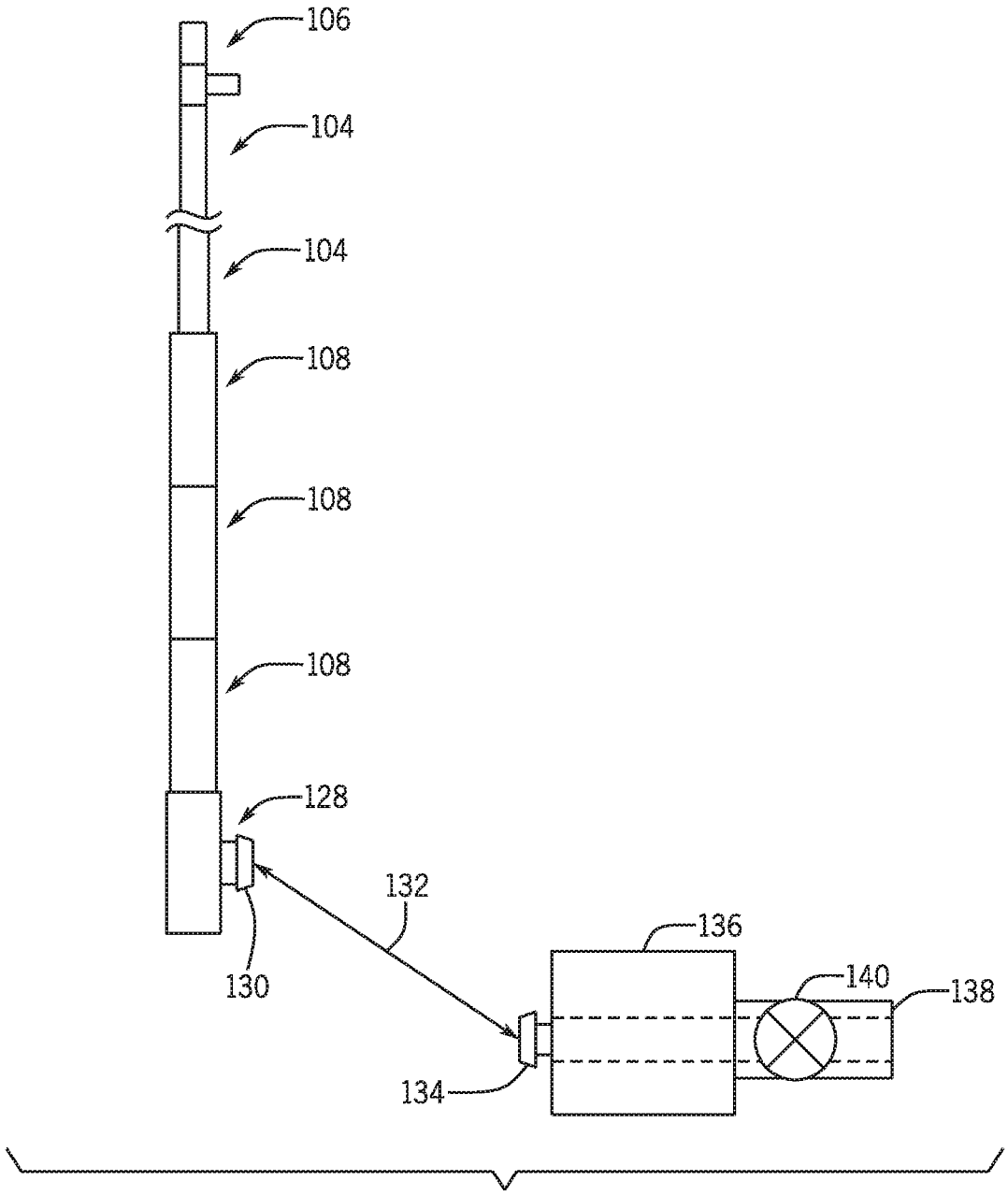
FIG. 8 illustrates a second schematic view of a drill string and associated equipment for use with the offshore platform of FIG. 1, in accordance with an embodiment.

In another embodiment, as illustrated in FIG. 8, an exit side sub 128 may be coupled to the one or more drill collars 108. This exit side sub 128 may have an output connector 130 coupled to a passage 132 (e.g., pipe, hose, or the like) to an input connector 134 of a conduit device 136. In one embodiment, one or more of the output connector 130 or the input connector 134 may be a breakaway device that is able to disengage the passage 132. Additionally, the, the conduit device 136 may include an output 138 that may be coupled to input 34 (e.g., the input kill connector of the subsea pressure reducing module 28), whereby control of the fluid transmitted to the input 34 may be actuated by valve 140. This connection will allow for de-pressurization of fluids via the subsea pressure reducing module 28 prior to any transmission thereof to the offshore platform 10.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a first input, that when in operation, is fluidly coupled to a choke line associated with a well control device;

a first output, that when in operation, is fluidly coupled to the choke line associated with the well control device;

a second input, that when in operation, is fluidly coupled to a kill line, wherein the kill line is associated with the well control device and operated in parallel with the choke line to remove an influx from a well;

a second output, that when in operation, is fluidly coupled to the kill line associated with the well control device;

at least one first valve, that when in operation, alters a pressure of a first fluid received at the first input and transmitted from the first output to remove the first fluid from a well; and at least one second valve, that when in operation, alters a pressure of a second fluid received at the second input and transmitted from the second output to remove the second fluid from the well.

2. The device of claim 1, wherein the well control device comprises a blowout preventer.

3. The device of claim 2, wherein the device is integrated into the blowout preventer.

4. The device of claim 2, wherein the device is affixed to the blowout preventer.

5. The device of claim 2, wherein the device is separate from the blowout preventer and fluidly coupled to the blowout preventer via the choke line and a passage.

6. The device of claim 1, wherein the at least one first valve is configured to reduce the pressure of the first fluid to alter the pressure of the first fluid.

7. The device of claim 1, wherein the at least one first valve is configured to reduce the pressure of the first fluid from at least 20,000 pounds per square inch (psi) to 15,000 psi or less to alter the pressure of the first fluid.

8. The device of claim 1, comprising a third output configured to transmit an indication related to the operation of the device.

9. A system, comprising:

a subsea pressure reducing module comprising:

a first input that when coupled to a choke line receives a fluid having a first pressure from a first portion of the choke line associated with a first portion of a well control device;

a second input that when coupled to a kill line receives a second fluid having the first pressure from a first portion of the kill line, wherein the kill line is associated with the first portion of the well control device and operated in parallel with the choke line to remove an influx from a well;

first pressure adjustment componentry coupled to the first input and configured to adjust the first pressure of the first fluid to a second pressure;

second pressure adjustment componentry coupled to the second input and configured to adjust the first pressure of the second fluid to the second pressure;

a first output coupled to the first pressure adjustment componentry and when coupled to a second portion of the choke line transmits the first fluid having the second pressure to the second portion of the choke line associated with a second portion of the well control device; and a second output coupled to the second pressure adjustment componentry and when coupled to a second portion of the kill line transmits the second fluid having the second pressure to the second portion of the kill line associated with the second portion of the well control device; and a control system configured to be coupled to the subsea pressure reducing module to monitor the operation of the subsea pressure reducing module.

10. The system of claim 9, wherein the control system is configured to receive a pressure indication of a valve of the first pressure adjustment componentry to monitor the operation of the subsea pressure reducing module.

11. The system of claim 9, wherein the control system is configured to transmit an indication of the operation of the subsea pressure reducing module.

12. The system of claim 11, wherein the control system is configured to analyze the operation of the subsea pressure reducing module to generate analyzed data and transmit the analyzed data as the indication of the operation of the subsea pressure reducing module.

13. The system of claim 9, wherein the control system is configured to control the operation of the pressure adjustment componentry of the subsea pressure reducing module.

14. The system of claim 9, wherein the control system is configured to be coupled to a blowout preventer as the well control device.

15. The system of claim 14, wherein the control system is configured to control operation of at least one portion of the blowout preventer.

16. A system, comprising:

a conduit, that when in operation, is fluidly coupled to a drill pipe to receive a fluid transmitted from an offshore platform via the drill pipe, the fluid having a first pressure of up to at least 20,000 psi, wherein the conduit comprises an output to transmit the fluid having the first pressure; and a subsea pressure reducing module, that when in operation, is coupled to the conduit, wherein the subsea pressure reducing module comprises:

an input that when coupled to the conduit receives the fluid having the first pressure;

pressure adjustment componentry coupled to the input and configured to adjust the fluid having the first pressure to the fluid having a second pressure; and an output coupled to the pressure adjustment componentry and when coupled to a first portion of a blowout preventer transmits the fluid having the second pressure to a first portion of a blowout preventer;

wherein the second pressure is less than the first pressure.

17. The system of claim 16, wherein the conduit comprises a receptacle configured to receive a stab to fluidly connect the drill pipe to the conduit.

18. The system of claim 16, wherein the conduit comprises an input connector configured to receive a passage to fluidly connect the drill pipe to the conduit.

19. The system of claim 18, wherein the input connector comprises a breakaway device configured to fluidly decouple the conduit from the drill pipe.

20. The system of claim 16, wherein the conduit comprises a valve configured to control transmission of the fluid having the first pressure to the input of the subsea pressure reducing module.

* * * * *